US007694379B2

(12) United States Patent
Glaug

(10) Patent No.: US 7,694,379 B2
(45) Date of Patent: Apr. 13, 2010

(54) ABSORBENT CLEANING PAD AND METHOD OF MAKING SAME

(75) Inventor: Frank S. Glaug, Chester Springs, PA (US)

(73) Assignee: First Quality Retail Services, LLC, Great Neck, NY (US)

( * ) Notice: Subject to any disclaimer, the term of this patent is extended or adjusted under 35 U.S.C. 154(b) by 1137 days.

(21) Appl. No.: 11/240,949

(22) Filed: Sep. 30, 2005

(65) Prior Publication Data

US 2007/0074364 A1 Apr. 5, 2007

(51) Int. Cl.
*A47L 13/20* (2006.01)

(52) U.S. Cl. ..... 15/228; 15/209.1; 15/227; 300/21

(58) Field of Classification Search ..... 15/209.1, 15/227, 228; 300/21
See application file for complete search history.

(56) References Cited

U.S. PATENT DOCUMENTS

| | | | |
|---|---|---|---|
| 869,842 | A | 10/1907 | Hill |
| 916,755 | A | 3/1909 | Moseke |
| 1,002,268 | A | 9/1911 | Hayden |
| 1,205,979 | A | 11/1916 | Dohm |
| 1,742,318 | A | 1/1930 | Newton et al. |
| 2,136,827 | A | 11/1938 | Schur |
| 2,301,505 | A | 11/1942 | Bates |
| 2,478,148 | A | 8/1949 | Wilson et al. |
| 2,581,069 | A | 1/1952 | Bertolet, Jr. |
| 2,733,468 | A | 2/1956 | Haber |
| 2,739,334 | A | 3/1956 | Hardey |
| 2,755,498 | A | 7/1956 | Park |
| 2,764,774 | A | 10/1956 | Belsky et al. |
| 2,777,148 | A | 1/1957 | Belsky et al. |
| 2,816,313 | A | 12/1957 | Beck et al. |
| 2,853,730 | A | 9/1958 | Belsky et al. |
| 2,916,759 | A | 12/1959 | Smith |
| 2,958,146 | A | 11/1960 | Van Dusen, Jr. et al. |
| 3,012,264 | A | 12/1961 | Nash |
| 3,015,834 | A | 1/1962 | Marrinson et al. |
| 3,025,202 | A | 3/1962 | Morgan et al. |
| 3,077,627 | A | 2/1963 | Ashworth |
| 3,099,855 | A | 8/1963 | Nash |
| 3,196,475 | A | 7/1965 | Brown |
| 3,199,136 | A | 8/1965 | George |
| 3,221,356 | A | 12/1965 | Schirmer |
| D205,500 | S | 8/1966 | Deitel et al. |
| 3,271,231 | A | 9/1966 | Moggio et al. |
| 3,362,037 | A | 1/1968 | Griffin |
| 3,395,415 | A | 8/1968 | Leland |
| 3,395,416 | A | 8/1968 | Hughes |
| 3,395,418 | A | 8/1968 | Malmo |
| 3,412,418 | A | 11/1968 | Griffin |
| 3,425,085 | A | 2/1969 | Moss |

(Continued)

FOREIGN PATENT DOCUMENTS

| | | | |
|---|---|---|---|
| EP | 1183977 | * | 3/2002 |

(Continued)

*Primary Examiner*—Mark Spisich
(74) *Attorney, Agent, or Firm*—Amster, Rothstein & Ebenstein LLP

(57) ABSTRACT

A surface cleaning pad comprising a pad body and an attachment surface associated with the pad body and positioned to face a cleaning implement is provided. The attachment surface comprises a substantially hydrophilic portion and a substantially hydrophobic portion.

21 Claims, 7 Drawing Sheets

U.S. PATENT DOCUMENTS

| | | | | |
|---|---|---|---|---|
| 3,449,784 | A | | 6/1969 | Moss |
| 3,473,184 | A | | 10/1969 | Buck, Jr. |
| 3,501,813 | A | | 3/1970 | Lee et al. |
| 3,528,076 | A | | 9/1970 | Anderson |
| 3,528,120 | A | | 9/1970 | Lindstrom |
| 3,545,876 | A | | 12/1970 | Leland |
| 3,581,706 | A | | 6/1971 | Rasmussen et al. |
| 3,593,359 | A | | 7/1971 | Strauss et al. |
| 3,680,170 | A | | 8/1972 | Sims |
| 3,692,622 | A | | 9/1972 | Dunning |
| 3,698,030 | A | | 10/1972 | Lockett |
| 3,711,886 | A | | 1/1973 | Strauss |
| 3,713,744 | A | | 1/1973 | Sims |
| 3,717,905 | A | | 2/1973 | Furbeck |
| 3,720,976 | A | | 3/1973 | Bailey |
| 3,733,234 | A | | 5/1973 | Dunning |
| 3,737,938 | A | | 6/1973 | Saltzstein |
| 3,760,450 | A | | 9/1973 | Griffin et al. |
| 3,761,991 | A | | 10/1973 | Moss |
| 3,764,451 | A | | 10/1973 | Dunning |
| 3,776,807 | A | | 12/1973 | Dunning et al. |
| 3,792,505 | A | | 2/1974 | Saltzstein |
| 3,825,381 | A | | 7/1974 | Dunning et al. |
| 3,827,100 | A | | 8/1974 | Griffin et al. |
| 3,836,346 | A | | 9/1974 | Stalego |
| 3,860,002 | A | | 1/1975 | Kolbach |
| 3,877,103 | A | | 4/1975 | Nash |
| 3,896,518 | A | | 7/1975 | Von Post et al. |
| 3,945,736 | A | | 3/1976 | Rittenbaum et al. |
| 3,964,213 | A | | 6/1976 | Tobey |
| 3,965,519 | A | | 6/1976 | Hermann |
| 3,966,519 | A | | 6/1976 | Mitchell et al. |
| 3,973,291 | A | | 8/1976 | Kolbach |
| 3,976,734 | A | | 8/1976 | Dunning et al. |
| 3,978,541 | A | | 9/1976 | Gustafsson |
| 3,991,431 | A | | 11/1976 | Thielen |
| 3,991,432 | A | | 11/1976 | Griffin et al. |
| 3,996,639 | A | | 12/1976 | Griffin et al. |
| 4,007,510 | A | | 2/1977 | Scoggin, Jr. et al. |
| 4,016,628 | A | | 4/1977 | Kolbach |
| 4,027,672 | A | | 6/1977 | Karami |
| 4,032,239 | A | | 6/1977 | Maupin |
| 4,070,726 | A | | 1/1978 | Joffre |
| 4,071,921 | A | * | 2/1978 | Jury ..... 15/227 |
| 4,071,983 | A | | 2/1978 | Thielen |
| 4,074,959 | A | | 2/1978 | Curry et al. |
| 4,087,506 | A | | 5/1978 | Cook et al. |
| 4,095,007 | A | | 6/1978 | Marshall |
| 4,099,288 | A | | 7/1978 | Rittenbaum et al. |
| 4,106,153 | A | | 8/1978 | Lemelson |
| 4,114,223 | A | | 9/1978 | Buchanan |
| 4,114,224 | A | | 9/1978 | Disko |
| RE29,789 | E | | 10/1978 | Kolbach |
| 4,141,772 | A | | 2/1979 | Buell |
| 4,153,664 | A | | 5/1979 | Sabee |
| 4,184,224 | A | | 1/1980 | Joffre |
| 4,193,751 | A | | 3/1980 | Miller |
| 4,212,302 | A | | 7/1980 | Karami |
| 4,213,459 | A | | 7/1980 | Sigl et al. |
| 4,217,078 | A | | 8/1980 | Buell |
| 4,219,899 | A | | 9/1980 | Zurawin et al. |
| 4,223,063 | A | | 9/1980 | Sabee |
| 4,225,998 | A | | 10/1980 | Thielen |
| 4,252,761 | A | | 2/1981 | Schoggen et al. |
| 4,264,289 | A | | 4/1981 | Day |
| 4,268,340 | A | | 5/1981 | Fitzgerald et al. |
| 4,351,793 | A | | 9/1982 | Day |
| 4,375,447 | A | | 3/1983 | Chung |
| 4,375,448 | A | | 3/1983 | Appel et al. |
| 4,377,230 | A | | 3/1983 | Bürkner |
| 4,388,056 | A | | 6/1983 | Lee et al. |
| 4,429,001 | A | | 1/1984 | Kolpin et al. |
| 4,435,234 | A | | 3/1984 | Hunt |
| 4,516,360 | A | | 5/1985 | Gringer et al. |
| 4,516,361 | A | | 5/1985 | Gringer |
| 4,551,191 | A | | 11/1985 | Kock et al. |
| 4,562,610 | A | | 1/1986 | Davis et al. |
| 4,564,969 | A | | 1/1986 | Heinonen |
| 4,575,891 | A | | 3/1986 | Valente |
| 4,583,486 | A | | 4/1986 | Miller |
| 4,585,448 | A | | 4/1986 | Enloe |
| 4,592,708 | A | | 6/1986 | Feist et al. |
| 4,598,441 | A | | 7/1986 | Stemmler |
| 4,600,458 | A | | 7/1986 | Kramer et al. |
| 4,601,938 | A | | 7/1986 | Deacon et al. |
| 4,603,069 | A | | 7/1986 | Haq et al. |
| 4,610,678 | A | | 9/1986 | Weisman et al. |
| D287,173 | S | | 12/1986 | Libman |
| 4,640,810 | A | | 2/1987 | Laursen et al. |
| 4,650,480 | A | | 3/1987 | Stemmler |
| 4,678,527 | A | | 7/1987 | Ulman |
| 4,685,167 | A | | 8/1987 | Murray |
| 4,685,915 | A | | 8/1987 | Hasse et al. |
| 4,698,871 | A | | 10/1987 | Patkos |
| 4,712,268 | A | | 12/1987 | Heinonen |
| 4,732,797 | A | | 3/1988 | Johnson et al. |
| 4,750,233 | A | | 6/1988 | Swain |
| 4,761,258 | A | | 8/1988 | Enloe |
| 4,764,325 | A | | 8/1988 | Angstadt |
| 4,765,780 | A | | 8/1988 | Angstadt |
| 4,769,267 | A | | 9/1988 | Hoyt |
| 4,769,283 | A | | 9/1988 | Sipinen et al. |
| 4,784,892 | A | | 11/1988 | Storey et al. |
| 4,793,019 | A | | 12/1988 | Stima et al. |
| 4,797,310 | A | | 1/1989 | Barby et al. |
| 4,808,474 | A | | 2/1989 | Sipinen |
| 4,811,449 | A | | 3/1989 | Kobayashi |
| 4,812,283 | A | | 3/1989 | Farley et al. |
| 4,813,944 | A | | 3/1989 | Haney et al. |
| 4,820,579 | A | | 4/1989 | Aszman |
| 4,823,427 | A | | 4/1989 | Gibbs et al. |
| 4,834,735 | A | | 5/1989 | Alemany et al. |
| 4,843,674 | A | | 7/1989 | Jones |
| 4,852,201 | A | | 8/1989 | Wundrock et al. |
| 4,852,210 | A | | 8/1989 | Krajicek |
| 4,859,388 | A | | 8/1989 | Peterson et al. |
| 4,902,544 | A | | 2/1990 | Kim et al. |
| 4,902,559 | A | | 2/1990 | Eschwey et al. |
| 4,904,440 | A | | 2/1990 | Angstadt |
| 4,908,175 | A | | 3/1990 | Angstadt |
| 4,927,346 | A | | 5/1990 | Kaiser et al. |
| 4,927,582 | A | | 5/1990 | Bryson |
| 4,935,158 | A | | 6/1990 | Aszman et al. |
| 4,945,599 | A | | 8/1990 | Flynn |
| D310,589 | S | | 9/1990 | Paciullo et al. |
| D310,901 | S | | 9/1990 | Paciullo et al. |
| D310,902 | S | | 9/1990 | Paciullo et al. |
| D311,318 | S | | 10/1990 | Ovens |
| 4,961,242 | A | | 10/1990 | Kresse et al. |
| 4,962,563 | A | | 10/1990 | Bachar |
| 4,971,471 | A | | 11/1990 | Sloan |
| 4,987,632 | A | | 1/1991 | Rowe et al. |
| 4,991,250 | A | | 2/1991 | Young |
| 4,995,133 | A | | 2/1991 | Newell |
| 5,004,579 | A | | 4/1991 | Wislinski et al. |
| 5,012,544 | A | | 5/1991 | Verry |
| 5,017,324 | A | | 5/1991 | Kaiser et al. |
| 5,028,224 | A | | 7/1991 | Pieper et al. |
| 5,028,646 | A | | 7/1991 | Miller et al. |
| 5,029,357 | A | | 7/1991 | Gootoff et al. |
| 5,042,105 | A | | 8/1991 | Buck et al. |
| 5,044,040 | A | | 9/1991 | Tetrault |
| 5,047,023 | A | | 9/1991 | Berg |
| 5,064,484 | A | | 11/1991 | Craig et al. |

5,066,527 A 11/1991 Newell
5,068,079 A 11/1991 Gustafsson
5,071,489 A 12/1991 Silvenis et al.
5,087,506 A 2/1992 Palumbo
5,090,832 A 2/1992 Rivera et al.
5,092,699 A 3/1992 Silvenis
5,094,559 A 3/1992 Rivera et al.
5,102,585 A 4/1992 Pieper et al.
5,115,535 A 5/1992 Casademunt Ferre et al.
5,128,082 A 7/1992 Makoui
5,138,738 A 8/1992 Nicholson
5,143,680 A 9/1992 Molnar et al.
5,143,779 A 9/1992 Newkirk et al.
5,156,902 A 10/1992 Pieper et al.
5,160,331 A 11/1992 Forester et al.
5,165,138 A 11/1992 Garabedian
5,176,668 A 1/1993 Bernardin
5,177,831 A 1/1993 Wirth
5,178,931 A 1/1993 Perkins et al.
5,205,012 A 4/1993 Coley
5,211,903 A 5/1993 Reifenhauser
5,213,817 A 5/1993 Pelley
5,217,787 A 6/1993 Monahan
5,226,991 A 7/1993 Svaighert
5,227,107 A 7/1993 Dickenson et al.
5,230,119 A 7/1993 Woods et al.
5,230,843 A 7/1993 Howard et al.
D338,705 S 8/1993 Spokoiny
5,248,524 A 9/1993 Soderlund
5,262,223 A 11/1993 Palumbo et al.
5,269,049 A 12/1993 Gustafsson et al.
5,279,854 A 1/1994 Kendall et al.
5,280,664 A 1/1994 Lin
5,288,220 A 2/1994 Kugler et al.
5,292,239 A 3/1994 Zeldin et al.
5,292,582 A 3/1994 Gibbs et al.
5,294,478 A 3/1994 Wanek et al.
5,304,160 A 4/1994 Igaue et al.
5,306,453 A 4/1994 Shulman
5,308,896 A 5/1994 Hansen et al.
5,330,456 A 7/1994 Robinson
5,331,711 A 7/1994 Kelly
5,333,347 A 8/1994 Stranders
5,343,587 A 9/1994 Findley
5,348,547 A 9/1994 Payne et al.
5,350,370 A 9/1994 Jackson et al.
5,356,403 A 10/1994 Faulks et al.
5,372,865 A 12/1994 Arakawa et al.
5,378,528 A 1/1995 Makoui
5,395,675 A 3/1995 Altholz et al.
5,397,413 A 3/1995 Trimble et al.
5,410,771 A 5/1995 Bereza
5,410,772 A 5/1995 Lewis
5,415,650 A 5/1995 Sigl
5,415,717 A 5/1995 Perneborn
5,419,015 A 5/1995 Garcia
5,422,169 A 6/1995 Roe
5,425,725 A 6/1995 Tanzer et al.
5,426,809 A 6/1995 Muta
5,429,788 A 7/1995 Ribble et al.
5,439,364 A 8/1995 Gerking et al.
5,442,830 A 8/1995 Ohm
5,445,777 A 8/1995 Noel et al.
5,447,677 A 9/1995 Griffoul et al.
5,451,442 A 9/1995 Pieniak et al.
5,452,491 A 9/1995 Thompson
5,454,659 A 10/1995 Vosbikian et al.
5,461,749 A 10/1995 Ahlberg et al.
5,462,537 A 10/1995 Carr et al.
5,470,653 A 11/1995 Honeycutt et al.
5,471,697 A 12/1995 Daconta
5,471,703 A 12/1995 Niven
5,477,582 A 12/1995 Yamashita
5,483,720 A 1/1996 Decoopman et al.
5,490,905 A 2/1996 Huovila et al.
5,494,622 A 2/1996 Heath et al.
5,505,718 A 4/1996 Roe et al.
5,507,065 A 4/1996 McBride et al.
5,514,122 A 5/1996 Morris et al.
5,514,324 A 5/1996 Bachar
5,525,397 A 6/1996 Shizuno et al.
5,540,332 A 7/1996 Kopacz et al.
5,553,344 A 9/1996 Rosenkrantz
5,558,713 A 9/1996 Siegfried et al.
5,562,645 A 10/1996 Tanzer et al.
5,567,472 A 10/1996 Siegfried et al.
5,569,230 A 10/1996 Fisher et al.
5,571,537 A 11/1996 Geus et al.
5,575,785 A 11/1996 Gryskiewicz et al.
5,592,713 A 1/1997 Rones
5,596,787 A 1/1997 Stevens et al.
5,609,255 A 3/1997 Nichols
5,613,263 A 3/1997 Nolte
5,614,147 A 3/1997 Pelley
5,618,281 A 4/1997 Betrabet et al.
5,620,432 A 4/1997 Goulait et al.
5,638,569 A 6/1997 Newell
5,672,404 A 9/1997 Callahan, Jr. et al.
5,678,278 A 10/1997 McBride et al.
5,681,305 A 10/1997 Korpman
5,707,731 A 1/1998 Honeycutt et al.
D391,710 S 3/1998 Hanaoka
D391,711 S 3/1998 Hanaoka et al.
5,740,578 A 4/1998 Moore
5,750,066 A 5/1998 Vonderhaar et al.
5,771,524 A 6/1998 Wood et al.
5,804,512 A 9/1998 Lickfield et al.
5,810,800 A 9/1998 Hunter et al.
5,815,878 A 10/1998 Murakami et al.
5,836,039 A 11/1998 Rimer
5,839,147 A 11/1998 Chia-Yi et al.
5,845,361 A 12/1998 Murakami et al.
5,863,565 A 1/1999 Rossillon et al.
5,885,516 A 3/1999 Christensen
5,888,006 A 3/1999 Ping et al.
D409,343 S 5/1999 Kingry et al.
5,904,674 A 5/1999 Bonjour
5,915,437 A 6/1999 Petner
5,916,507 A 6/1999 Dabi et al.
5,916,670 A 6/1999 Tan et al.
5,922,140 A 7/1999 Wills
5,926,896 A 7/1999 Allemann et al.
D413,417 S 8/1999 Reede
5,937,471 A 8/1999 Liao
5,944,706 A 8/1999 Palumbo et al.
5,953,784 A 9/1999 Suzuki et al.
5,960,508 A 10/1999 Holt et al.
5,972,265 A 10/1999 Marra et al.
D417,050 S 11/1999 Reede
5,988,920 A 11/1999 Kunkler et al.
5,989,478 A 11/1999 Ouellette et al.
5,997,989 A 12/1999 Gessner et al.
6,003,191 A 12/1999 Sherry et al.
6,004,308 A 12/1999 Haddock
6,006,761 A 12/1999 Meledandri
D420,561 S 2/2000 Kunkler
6,020,536 A 2/2000 Osterdahl et al.
6,022,818 A 2/2000 Welchel et al.
RE36,601 E 3/2000 Woods et al.
D423,742 S 4/2000 Kingry et al.
6,045,622 A 4/2000 Holt et al.
6,047,435 A 4/2000 Suzuki et al.
6,048,123 A 4/2000 Holt et al.
6,048,489 A 4/2000 Reiter et al.
D426,039 S 5/2000 Tintelnot et al.
6,098,239 A 8/2000 Vosbikian 6,098,249 A 8/2000 Toney et al.
6,101,661 A 8/2000 Policicchio et al.
6,119,298 A 9/2000 Kenmochi
6,127,594 A 10/2000 Rosseland
6,141,820 A 11/2000 Schmiedhoff et al.
6,142,750 A 11/2000 Benecke
6,143,393 A 11/2000 Abe et al.
6,159,596 A 12/2000 Calhoun et al.
6,170,114 B1 1/2001 Woodnorth et al.
6,172,276 B1 1/2001 Hetzler et al.
6,202,250 B1 3/2001 Kenmochi et al.
6,202,259 B1 3/2001 Burr et al.
6,207,602 B1 3/2001 Gessner et al.
6,218,593 B1 4/2001 Torimae et al.
6,220,999 B1 4/2001 Kugler et al.
6,243,909 B1 6/2001 Graham et al.
6,245,413 B1 6/2001 Kenmochi et al.
D445,227 S 7/2001 Tintelnot
6,293,934 B1 9/2001 Kumasaka
6,298,517 B1 10/2001 McKay
6,305,046 B1 10/2001 Kingry et al.
6,317,917 B1 11/2001 Hsu
6,319,593 B1 11/2001 Kenmochi et al.
6,330,735 B1 12/2001 Hahn et al.
6,331,345 B1 12/2001 Kauschke et al.
6,332,234 B1 12/2001 Graham et al.
6,332,346 B2 12/2001 Komiya et al.
6,332,996 B1 12/2001 Dit Picard et al.
6,368,609 B1 4/2002 Fontenot et al.
6,380,151 B1 4/2002 Masters et al.
6,389,637 B1 5/2002 Hurell
6,405,403 B1 6/2002 McKay
D461,028 S 7/2002 Ng
D461,029 S 7/2002 Ng
6,416,697 B1 7/2002 Venturino et al.
6,423,048 B1 7/2002 Suzuki et al.
D462,150 S 8/2002 Rader et al.
6,437,214 B1 8/2002 Everett et al.
6,443,936 B1 9/2002 Hamilton et al.
6,454,690 B2 9/2002 Kugler et al.
D464,181 S 10/2002 Ng
6,458,299 B1 10/2002 Wierer et al.
6,458,442 B1 10/2002 McKay
6,461,086 B1 10/2002 Milanowski et al.
6,465,378 B2 10/2002 Gessner et al.
D465,890 S 11/2002 Rivera et al.
6,479,061 B2 11/2002 Fontenot et al.
6,484,346 B2 11/2002 Kingry et al.
6,485,667 B1 11/2002 Tan
6,503,238 B1 1/2003 Torstensson et al.
6,511,466 B1 1/2003 Nagami et al.
6,513,184 B1 2/2003 Brown et al.
6,540,424 B1 4/2003 Hall et al.
6,550,092 B1 4/2003 Brown et al.
6,554,937 B1 4/2003 Kenmochi et al.
D477,701 S 7/2003 Kunkler et al.
6,591,442 B2 7/2003 Kaminstein
6,601,261 B1 8/2003 Holt et al.
6,606,757 B2 8/2003 Vosbikian et al.
6,611,986 B1 9/2003 Seals
6,617,490 B1 9/2003 Chen et al.
6,623,576 B2 9/2003 Mitchell et al.
D481,184 S 10/2003 Clare et al.
D482,829 S 11/2003 Vosbikian et al.
6,651,290 B2 11/2003 Kingry et al.
6,652,498 B1 11/2003 Glasgow et al.
6,652,798 B1 11/2003 Edvardsson
6,656,569 B1 12/2003 Roussel et al.
6,659,670 B1 12/2003 Blouse
6,663,306 B2 12/2003 Policicchio et al.
6,664,438 B1 12/2003 Guidotti
6,669,391 B2 12/2003 Policicchio et al.
6,681,434 B2 1/2004 Smith
D486,616 S 2/2004 Hall et al.
D487,173 S 2/2004 Clare et al.
6,684,445 B1 2/2004 Rio et al.
6,687,943 B2 2/2004 Zorzo
6,692,172 B1 2/2004 Hsu
6,692,603 B1 2/2004 Lindsay et al.
6,701,567 B2 3/2004 Smith
6,705,792 B2 3/2004 Smith
6,710,099 B2 3/2004 Cinelli et al.
6,710,225 B1 3/2004 Everett et al.
6,716,206 B2 4/2004 Jackson
6,717,029 B2 4/2004 Baker
6,723,892 B1 4/2004 Daley et al.
6,871,372 B2 4/2004 Vosbikian et al.
6,737,009 B2 5/2004 Taylor et al.
6,743,318 B2 6/2004 Vaders
6,745,434 B2 6/2004 Smith et al.
6,750,165 B2 6/2004 Kakiuchi et al.
6,766,552 B1 7/2004 Policicchio et al.
D494,721 S 8/2004 Kotani
6,781,027 B2 8/2004 Fenwick et al.
6,783,722 B2 8/2004 Taylor
D497,699 S 10/2004 Chi-Hsiang et al.
6,802,833 B2 10/2004 Kudo
6,803,334 B2 10/2004 Mizutani et al.
6,807,702 B2 10/2004 Keck et al.
6,810,554 B2 11/2004 McKay
6,811,338 B1 11/2004 Manske, Jr. et al.
6,811,642 B2 11/2004 Ochi
6,813,799 B2 11/2004 Otsuji et al.
6,813,801 B2 11/2004 Tanaka et al.
6,814,519 B2 11/2004 Policicchio et al.
6,815,058 B2 11/2004 Watanabe et al.
6,818,166 B2 11/2004 Edwardson et al.
6,840,926 B2 1/2005 Nukina et al.
6,842,936 B2 1/2005 Policicchio et al.
6,844,066 B2 1/2005 Hamed
6,846,448 B2 1/2005 Rymer et al.
6,851,164 B2 2/2005 Andersen
6,854,911 B2 2/2005 Policicchio et al.
6,866,740 B2 3/2005 Vaders
6,878,238 B2 4/2005 Bakken et al.
6,888,044 B2 5/2005 Fell et al.
6,890,622 B2 5/2005 Adam et al.
6,893,522 B1 5/2005 Crainic
6,893,525 B1 5/2005 Schmidt et al.
6,910,823 B2 6/2005 Policicchio et al.
6,911,022 B2 6/2005 Steger et al.
6,911,174 B2 6/2005 Creagan
6,923,798 B2 8/2005 Heden et al.
6,939,492 B2 9/2005 Jackson et al.
6,948,873 B2 9/2005 Policicchio et al.
6,968,591 B2 11/2005 Tanaka
6,993,805 B2 2/2006 Prodoehl et al.
7,013,528 B2 3/2006 Parker et al.
7,024,721 B2 4/2006 McKay
7,028,364 B2 4/2006 Policicchio et al.
7,033,965 B2 4/2006 Takabayashi et al.
7,039,969 B2 5/2006 Zorzo
7,096,531 B2 8/2006 Policicchio
7,137,169 B2 11/2006 Murphy et al.
7,144,173 B2 12/2006 Policicchio et al.
7,163,349 B2 1/2007 Policicchio et al.
7,175,727 B2 2/2007 Melius
2002/0042962 A1 4/2002 Willman et al.
2002/0050016 A1 5/2002 Willman et al.
2002/0168216 A1 11/2002 Policicchio et al.
2002/0168910 A1 11/2002 Vuillaume et al.
2002/0174500 A1 11/2002 Micciche et al.
2002/0180092 A1 12/2002 Abba et al.
2002/0193032 A1 12/2002 Newkirk et al.
2003/0003830 A1 1/2003 Ouederni et al.
2003/0009839 A1 1/2003 Streutker et al.

2003/0024062 A1 2/2003 McKay
2003/0028988 A1 2/2003 Streutker et al.
2003/0041953 A1 3/2003 Farell et al.
2003/0044569 A1 3/2003 Kacher et al.
2003/0045197 A1 3/2003 Kakiuchi et al.
2003/0049407 A1 3/2003 Kacher et al.
2003/0070746 A1 4/2003 Woods et al.
2003/0082358 A1 5/2003 Wenstrup
2003/0106568 A1 6/2003 Keck et al.
2003/0110584 A1 6/2003 Clare et al.
2003/0114067 A1 6/2003 Matela et al.
2003/0119400 A1 6/2003 Beitz et al.
2003/0119401 A1 6/2003 Chakravarty et al.
2003/0119402 A1 6/2003 Melius et al.
2003/0120238 A1 6/2003 Gustavsson et al.
2003/0121116 A1* 7/2003 Keck et al. ..... 15/104.94
2003/0126710 A1 7/2003 Policicchio et al.
2003/0135181 A1 7/2003 Chen et al.
2003/0140441 A1 7/2003 Stafford
2003/0157856 A1 8/2003 Schroeder et al.
2003/0180083 A1 9/2003 Hall et al.
2003/0195485 A1 10/2003 Rangachari et al.
2003/0200991 A1 10/2003 Keck et al.
2003/0203162 A1 10/2003 Fenwick et al.
2003/0203691 A1 10/2003 Fenwick et al.
2003/0211802 A1 11/2003 Keck et al.
2003/0219591 A1 11/2003 Bany et al.
2003/0220039 A1 11/2003 Chen et al.
2003/0221274 A1 12/2003 Makhija et al.
2003/0224686 A1 12/2003 Andersen
2003/0227106 A1 12/2003 Fuller et al.
2003/0236510 A1 12/2003 Yasumura et al.
2004/0011382 A1 1/2004 Kingry et al.
2004/0019995 A1 2/2004 Kowalski et al.
2004/0031119 A1 2/2004 McKay
2004/0038008 A1 2/2004 Levine et al.
2004/0043214 A1 3/2004 Topolkaraev et al.
2004/0049166 A1 3/2004 Chen et al.
2004/0054331 A1 3/2004 Hamilton et al.
2004/0064119 A1 4/2004 Guidotti et al.
2004/0074520 A1 4/2004 Truong et al.
2004/0087928 A1 5/2004 Ducker
2004/0093678 A1 5/2004 Hart et al.
2004/0102124 A1 5/2004 Suzuki
2004/0111817 A1 6/2004 Chen et al.
2004/0121686 A1 6/2004 Wong et al.
2004/0128786 A1* 7/2004 Policicchio et al. ..... 15/228
2004/0140048 A1 7/2004 Lindsay et al.
2004/0177863 A1 9/2004 McKay
2004/0177935 A1 9/2004 Hamed et al.
2004/0192136 A1 9/2004 Gusky et al.
2004/0204697 A1 10/2004 Litvay
2004/0206372 A1 10/2004 Holt et al.
2004/0206464 A1 10/2004 Li et al.
2004/0234760 A1 11/2004 Hamed
2004/0253892 A1 12/2004 Baker et al.
2004/0253893 A1 12/2004 Castellani
2004/0253894 A1 12/2004 Fell et al.
2004/0254551 A1 12/2004 Carnes et al.
2005/0000047 A1 1/2005 Kelly et al.
2005/0004541 A1 1/2005 Roberts
2005/0039287 A1 2/2005 Moser
2005/0045296 A1 3/2005 Adam et al.
2005/0054253 A1 3/2005 Minoguchi et al.
2005/0055791 A1 3/2005 Lin
2005/0061356 A1 3/2005 Wong et al.
2005/0079361 A1 4/2005 Hamed et al.
2005/0081888 A1 4/2005 Pung et al.
2005/0085150 A1 4/2005 Hamed
2005/0092417 A1 5/2005 Billgren et al.
2005/0109442 A1 5/2005 Neubauer et al.
2005/0109449 A1 5/2005 Scott et al.
2005/0112980 A1 5/2005 Strandqvist et al.
2005/0113776 A1 5/2005 Venturino et al.
2005/0113791 A1 5/2005 Neubauer et al.
2005/0118399 A1 6/2005 Perneborn
2005/0118916 A1 6/2005 Ducker et al.
2005/0120497 A1 6/2005 Lynde et al.
2005/0130539 A1 6/2005 Allen et al.
2005/0132518 A1 6/2005 Chen et al.
2005/0138749 A1 6/2005 Keck et al.
2005/0155630 A1 7/2005 Kilkenny et al.
2005/0166347 A1 8/2005 Fereshtehkhou et al.
2005/0170728 A1 8/2005 Crainic

FOREIGN PATENT DOCUMENTS

EP 1183978 * 3/2002
JP 2005-103222 * 4/2005

* cited by examiner

ABSORBENT CLEANING PAD AND METHOD OF MAKING SAME

FIELD OF THE INVENTION

The present invention relates to an absorbent cleaning pad and to a method for fabricating the absorbent cleaning pad.

BACKGROUND OF THE INVENTION

Conventional floor mops comprise a handle rotatably connected to a mop head and a disposable absorbent cleaning pad coupled to the mop head in a variety of different configurations. One side of the disposable absorbent cleaning pad is placed in direct contact with a surface to be cleaned and the opposing side of the cleaning pad is in contact with the mop head. The absorbent pad absorbs and retains fluids, and loosens and traps dirt particles on the cleaning surface.

The art is replete with a wide variety of mechanisms which are configured to couple an absorbent cleaning pad to a mop head. These mechanisms generally allow for releasable attachment of the cleaning pad to the mop head so that the cleaning pad can be removed and discarded after use.

For example, a removable absorbent cleaning pad coupled to a mop head is disclosed in U.S. Pat. No. 4,114,223. The double-sided cleaning pad of '223 encases the body of the mop head. A plurality of fastener ties positioned on an open end of the removable cleaning pad are utilized to constrict the cleaning pad around the body of the mop head. A disposable absorbent cleaning pad coupled to a mop head is also disclosed in U.S. Pat. No. 6,766,552. The disposable absorbent cleaning pad of '552 provides VELCRO loop fasteners which couple with VELCRO hook fasteners positioned on the underside of the mop head. Another example of a disposable absorbent cleaning pad coupled to a mop head is disclosed in U.S. Pat. Nos. 6,810,554 and 6,807,702. In these examples, the disposable cleaning pad provides extended attachment tabs which are configured for insertion into retaining apertures positioned on the topside of the mop head.

A disposable absorbent cleaning pad coupled to a mop head is also disclosed in U.S. Pat. No. 3,991,431. The removable absorbent cleaning pad of '431 provides pliable clips that releasably engage with rigid tabs positioned on the mop head. The engagement between the pliable clips and the rigid tabs facilitate the assembly and removal of the cleaning pad from the mop head. Still another example of a disposable absorbent cleaning pad coupled to a mop head is disclosed in U.S. Pat. No. 3,473,184. The mop head of '184 comprises an upper plate and a lower plate separated by a gap. The periphery of a disposable absorbent cleaning pad is positioned in the gap and compressed between the plates. A wing nut positioned above the upper plate engages with a threaded fastener coupled to the lower plate. The rotation of the wing nut translates the upper plate to control the size of the gap between the plates and the compression of the cleaning pad between the plates.

Nevertheless, there continues to be a need to further refine and improve absorbent cleaning pads and the mechanisms used to attach a disposable cleaning pad to a cleaning implement.

SUMMARY OF THE INVENTION

According to one aspect of the invention, a surface cleaning pad comprising a pad body and an attachment surface associated with the pad body and positioned to face a cleaning implement is provided. The attachment surface comprises a substantially hydrophilic portion and a substantially hydrophobic portion.

According to another aspect of the invention, a surface cleaning pad for use with a cleaning implement is provided. The surface cleaning pad consists of a unitized pad body formed from an airlaid composite. A barrier layer is coupled adjacent a cleaning-implement-facing surface of the unitized pad body and a hydrophobic layer is coupled adjacent the barrier layer. A position adhesive is applied to the hydrophobic layer and is positioned for engaging the cleaning implement. A release sheet is applied over a functional surface of the position adhesive.

According to yet another aspect of the invention, a method is provided for assembling a surface cleaning pad consisting of the step of applying a barrier layer to a cleaning implement facing surface of an airlaid composite. The barrier layer is folded over at least one edge of the airlaid composite, thereby encapsulating the edge of the airlaid composite. The barrier layer is applied to an opposing surface of the pad body that is positioned to face a surface to be cleaned and a hydrophobic layer is positioned over the barrier layer. A position adhesive is coupled to the hydrophobic layer, wherein a functional surface of the position adhesive is configured to engage a cleaning implement. A release sheet is mounted to the functional surface of the position adhesive.

According to still another aspect of the invention, a surface cleaning pad comprising a unitized pad body formed from an airlaid composite is provided. The unitized pad body includes a cleaning-implement-facing surface configured to face the cleaning implement and a surface-cleaning surface, wherein at least a portion of the surface-cleaning surface is exposed for direct contact with a surface to be cleaned. A barrier layer is coupled adjacent the cleaning-implement-facing surface of the unitized pad body and positioned to face the cleaning implement, wherein the barrier layer comprises a hydrophobic portion.

BRIEF DESCRIPTION OF THE DRAWINGS

The invention is best understood from the following detailed description when read in connection with the accompanying drawings. It is emphasized that, according to common practice, the various features of the drawings are not to scale. On the contrary, the dimensions of the various features are arbitrarily expanded or reduced for clarity. Included in the drawings are the following figures.

DETAILED DESCRIPTION OF THE INVENTION

Figure 1A:
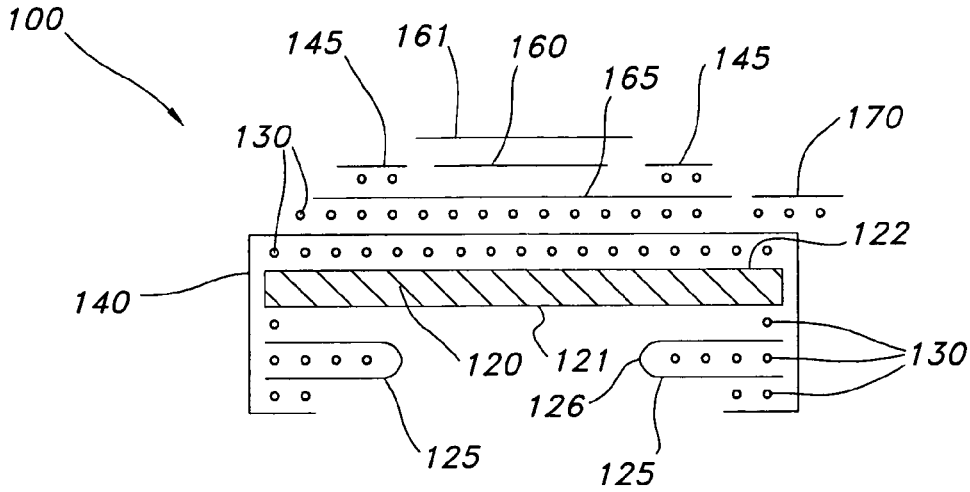
FIG. 1A is a cross-sectional view of the absorbent cleaning pad taken along the line 1A-1A illustrated in FIG. 1.

Although the invention is illustrated and described herein with reference to specific embodiments, the invention is not intended to be limited to the details shown. Rather, various modifications may be made in the details within the scope and range of equivalents of the claims and without departing from the invention. Also, the embodiments selected for illustration in the figures are not shown to scale and are not limited to the proportions shown.

As used herein, the term "hydrophilic" is used to refer to surfaces that have an affinity for water and readily absorb or dissolve in a liquid. Conversely, the term "hydrophobic" is used to refer to surfaces that repel or tend not to combine with or dissolve in a liquid.

Referring generally to the figures and according to one aspect of the invention, a surface cleaning pad 100, 200, 300, 400, 500, 600 comprising a pad body 120, 220, 320, 420, 520, 620 and an attachment surface 122 associated with the pad body and positioned to face a cleaning implement (not shown) is provided. The attachment surface 122 comprises a substantially hydrophilic portion 140, 240, 340, 440, 540, 642 and a substantially hydrophobic portion 165, 265, 641.

According to another aspect of the invention, a surface cleaning pad 100, 200, 300, 400, 500, 600 for use with a cleaning implement is provided. The surface cleaning pad consists of a unitized pad body 120, 220, 320, 420, 520, 620 formed from an airlaid composite. A barrier layer 140, 240, 340, 440, 540, 640 is coupled adjacent a cleaning-implement-facing surface 122 of the unitized pad body and a hydrophobic layer 165, 265, 641 is coupled adjacent the barrier layer. A position adhesive 160, 260, 360, 560, 660 is applied to the hydrophobic layer and is positioned for engaging the cleaning implement. A release sheet 161, 261, 361, 561, 661 is applied over a functional surface of the position adhesive.

According to yet another aspect of the invention, a method is provided for assembling a surface cleaning pad 100, 200, 300, 400, 500, 600 consisting of the step of applying a barrier layer 140, 240, 340, 440, 540, 640 to a cleaning implement facing surface 122 of an airlaid composite 120, 220, 320, 420, 520, 620. The barrier layer is folded over at least one edge of the airlaid composite, thereby encapsulating the edge of the airlaid composite. The barrier layer 140, 240, 340, 440, 540, 640 is applied to an opposing surface 121 of the pad body that is positioned to face a surface to be cleaned and a hydrophobic layer 165, 265, 641 is positioned over the barrier layer. A position adhesive 160, 260, 360, 560, 660 is coupled to the hydrophobic layer 165, 265, 641, wherein a functional surface of the position adhesive is configured to engage a cleaning implement. A release sheet 161, 261, 361, 561, 661 is mounted to the functional surface of the position adhesive.

According to still another aspect of the invention, a surface cleaning pad 100, 200, 300, 400, 500, 600 comprising a unitized pad body 120, 220, 320, 420, 520, 620 formed from an airlaid composite is provided. The unitized pad body includes a cleaning-implement-facing surface 122 configured to face the cleaning implement and a surface-cleaning surface 121, wherein at least a portion of the surface-cleaning surface 121 is exposed for direct contact with a surface to be cleaned. A barrier layer 140, 240, 340, 440, 540, 640 is coupled adjacent the cleaning-implement-facing surface 122 of the unitized pad body and positioned to face the cleaning implement, wherein the barrier layer 140, 240, 340, 440, 540, 640 comprises a hydrophobic portion 165, 265, 641.

Figure 1:
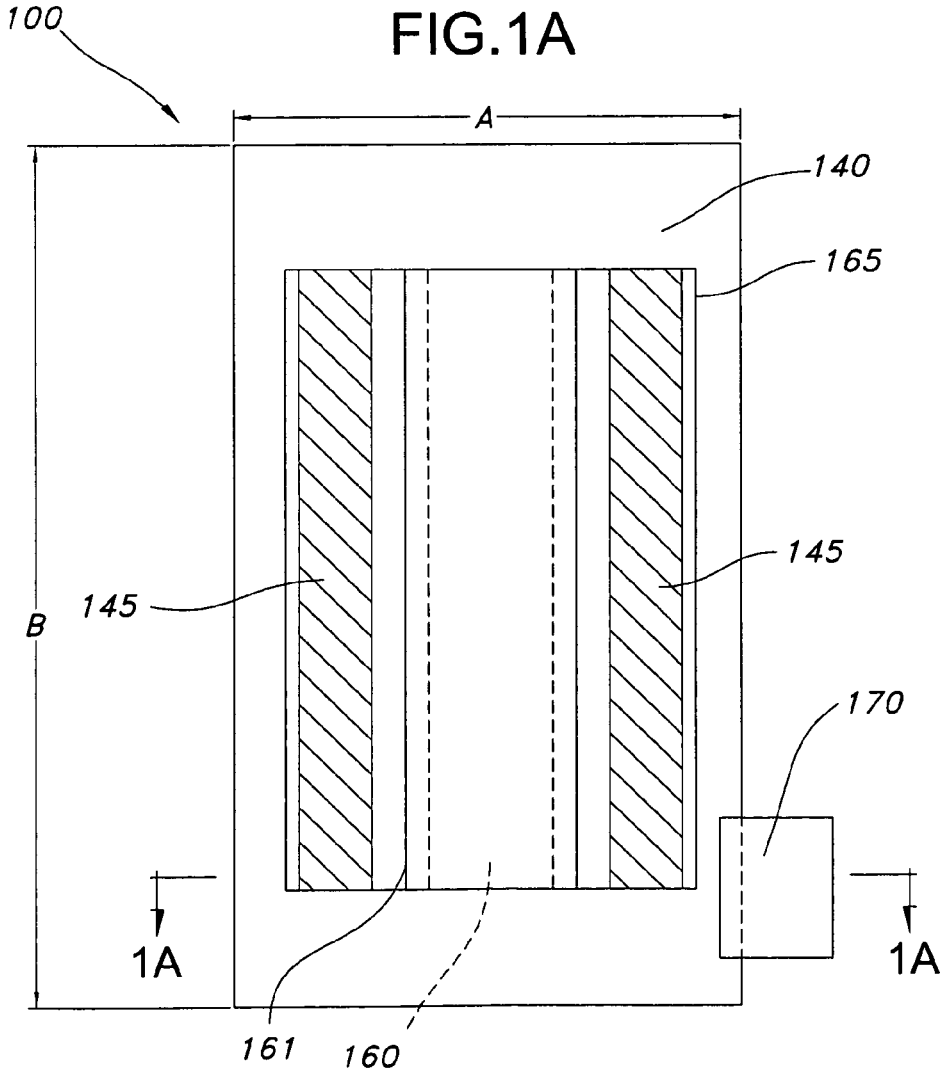
FIG. 1 is a top plan view of an absorbent cleaning pad in accordance with an exemplary embodiment of the present invention.
Figure 1B:
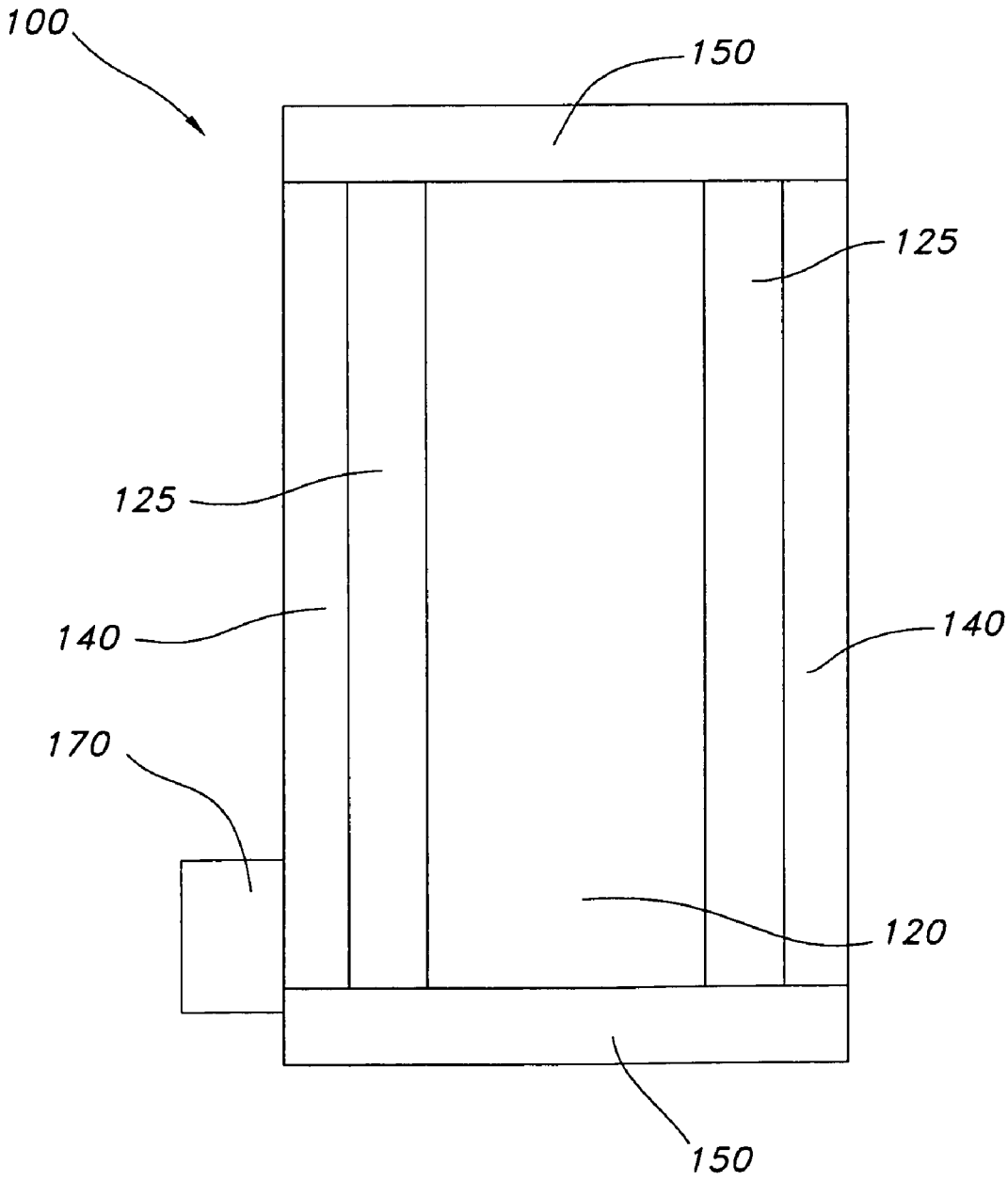
FIG. 1B is a bottom plan view of the absorbent cleaning pad illustrated in FIG. 1.

Referring specifically to the exemplary embodiment illustrated in FIGS. 1, 1A and 1B, an absorbent cleaning pad is designated generally by the numeral "100". Generally, the absorbent cleaning pad 100 has a pad body 120 that absorbs and retains fluid removed from a cleaning surface. The cleaning side 121 of the pad body 120 is configured for cleansing contact with the cleaning surface. The opposing attachment side 122 of the pad body 120 is configured to be positioned facing a cleaning implement (not shown).

A barrier layer 140 is folded over the length-wise sides of the pad body 120 to limit the escapement of super absorbent polymer (SAP) particles from the exposed length-wise sides of the pad body 120, if the pad body 120 is an airlaid composite having SAP particles. A pair of lofty cuffs 125 adhered to the cleansing side 121 of the pad body 120 trap and retain large dirt particles removed from the cleaning surface. Two cut and place barriers 150 are adhered to both lofty cuffs 125 and the folded portion of the barrier layer 140, as illustrated in FIG. 1B.

A tab portion 170 adhered to the barrier layer 140 extends beyond an edge of the pad body 120 and is configured to be grasped by a user of the cleaning implement to facilitate detachment of the cleaning pad 100 from the cleaning implement. An optional film layer 165 adhered to the barrier layer 140 provides a smooth surface to mount a position adhesive 160. The position adhesive 160 mounted to the film layer 165 is configured to releasably mount to a cleaning implement. A release sheet 161 is releasably mounted to the position adhesive 160 and removed from the position adhesive 160 prior to attachment to a cleaning implement. Two attachment members 145 adhered to the film layer 165 are configured to mount to a bottom side of the cleaning implement.

Although this cleaning pad embodiment comprises two attachment members 145 and the position adhesive assembly (i.e. 160, 165, 161) mounted to the barrier layer 140, the cleaning pad may only comprise two attachment members 145 mounted to the barrier layer 140 or the position adhesive assembly mounted to the barrier layer 140.

Regarding each component of the cleaning pad 100 of this exemplary embodiment, the pad body 120 of this exemplary embodiment absorbs and retains fluids and/or other matter residing on a cleaning surface. The pad body 120 is optionally formed from an airlaid composite. An airlaid composite is a unitized body with an absorbent core generally composed of wood pulp, binder fibers and optionally impregnated with super absorbent polymer (SAP) particles. The airlaid composite is formed by an airlaying or other process. The binder fibers form the overall structure of the pad body 120 and the wood fibers and SAP particles provide absorbency to the pad body 120. The term "unitized" refers to the airlaid composite as being composed of one material composite. However, the airlaid composite may be composed of multiple material layers adhered to one another. Additional benefits and features of an airlaid composite construction are disclosed in U.S. application Ser. No. 11/240,929, filed concurrently herewith. The disclosure of U.S. application Ser. No. 11/240,929 is incorporated herein by reference in its entirety.

The width "A" of the cleaning pad 100 may be any dimension sufficient to cover all or a portion of the width of a surface of a cleaning implement, such as a mop head for example. For the purposes of illustration only, the width "A" may be about 5.7 inches. The length "B" of the cleaning pad 100, as illustrated in FIG. 1, may be any dimension sufficient to cover all or a portion of the length of the cleaning implement. For the purposes of illustration only, the length "B" may be about 11.6 inches. The thickness of the pad body 120, as illustrated in FIG. 1A, may be any dimension sufficient to absorb an appropriate volume of fluid and retain its structural integrity when wet.

The lofty cuff 125 facilitates the removal of soils from the surface being cleaned by contacting and trapping larger soil particles. The lofty cuff 125 may be folded and adhered to itself for structural integrity or a single ply of lofty cuff material could be selected to provide enhanced structural properties. The lofty cuff 125 material has a relatively large and open pore structure to trap particles and is configured to be flexible, sustain multiple uses and resist tearing or deformation. The lofty cuff 125 may optionally be composed of apertured polyethylene or polypropylene films, foams, airlaids, wetlaids, or laminations and combinations thereof. The lofty cuff 125 component may be either hydrophilic or hydrophobic.

In this exemplary embodiment, a portion of each lofty cuff 125 is bonded to the cleaning side 121 of the pad body 120 and barrier layer 140, and the two cut-and-place barriers 150 are adhered to the ends of both lofty cuff 125 with an adhesive 130. Furthermore, by fastening only three sides of each lofty cuff 125, the closed-face folded end 126 of each lofty cuff 125 is unrestricted and a pocket or pouch is formed between the lofty cuff 125 and the pad body 120. The pouch provides an area to store collected dirt particles removed from the cleaning surface. The pouch traps large particles as the cleaning pad 100 is wiped back and forth along the cleaning surface. The pouches also substantially prevent the large particles from redepositing onto the cleaning surface. Additional benefits and features of a lofty cuff are disclosed in U.S. application Ser. No. 11/241,437, filed concurrently herewith. The disclosure of U.S. application Ser. No. 11/241,437 is incorporated herein by reference in its entirety.

The barrier layer 140 covers the attachment side 122 of the pad body 120 and is folded over the length-wise sides of the pad body 120. The barrier layer 140 is folded over the length-wise sides to limit the escapement of SAP particles from the exposed length-wise sides of the pad body 120, if the pad body 120 is formed from an airlaid composite containing SAP particles. Accordingly, the barrier layer 140 may not be required if the pad body 120 does not included SAP particles. Additional benefits and features of a cleaning pad configured to limit the escapement of SAP particles are disclosed in U.S. patent application Ser. No. 11/240,726, filed concurrently herewith. The disclosure of U.S. application Ser. No. 11/240,726 is incorporated herein by reference in its entirety.

The portion of the barrier layer 140 folded over the length-wise sides of the pad body 120 may be formed from a hydrophilic material to facilitate the removal of fluid from the surface being cleaned since that portion is in fluid communication with the surface being cleaned. If the barrier layer 140 was entirely formed from a hydrophobic material, the length-wise sides of the barrier layer 140 would merely push the fluid over the surface being cleaned, instead of delivering the fluid into the pad body 120. However, as described in further detail later, the barrier layer may be formed from an entirely hydrophilic material, an entirely hydrophobic material, or, alternatively, a partially hydrophilic and partially hydrophobic material.

The film layer 165 is utilized to keep the cleaning implement substantially free of fluid and provide a smooth surface to mount the position adhesive 160 and the attachment members 145. The film layer 165 is mounted to the top of the barrier layer 140 with an adhesive 130. The surface of the film layer 165 is desirably non-porous for adequate adhesion of the position adhesive 160, and is desirably hydrophobic to limit fluid from passing to the position adhesive. Non-limiting examples of suitable materials include plastics such as polyethylene, polypropylene, polyester, and similar materials, as well as hydrophobic foams, airlaids, wetlaids, and laminations thereof. The film layer 165 optionally takes the form of a film, sheet, or similar substrate.

The cut and place barriers 150 cover the exposed width-wise sides of the pad body 120 to limit the escapement of SAP particles from the width-wise sides of the pad body 120, if the pad body 120 is optionally formed from an airlaid composite containing SAP particles. Accordingly, the cut and place barriers 150 may not be required if the pad body 120 does not included SAP particles. Each cut and place barrier 150 overlaps with and is adhered to both the lofty cuffs 125 and the barrier layer 140 with an adhesive 130. Similar to the barrier layer 140, the cut and place barrier 150 is desirably formed from a hydrophilic material configured to deliver the fluid to the pad body 120 for absorption and removal of the fluid from the cleaning surface. In this embodiment, the cut and place barrier layer 150 is optionally formed from a hydrophilic non-woven material.

The attachment members 145 facilitate releasable engagement of the cleaning pad 100 to a surface of a cleaning implement. That surface may be the bottom side surface of a mop head or another portion of a cleaning implement. The attachment members 145 are adhered to the hydrophobic film layer 165 with an adhesive 130. The attachment members 145 are optionally positioned along either a portion of or the entire length of the barrier layer 140 and are separated by a distance from the length-wise sides of the barrier layer 140, as illustrated in FIG. 1. Although two longitudinally positioned attachment members 145 are selected for illustration, a cleaning pad may have any number of attachment members 145 positioned in any orientation.

In this exemplary embodiment, the attachment members 145 are composed of hook or loop material such as VELCRO loop material available from Velcro USA Inc. of Manchester, N.H., USA. The attachment members 145 illustrated in FIG. 1 are loop fasteners such as a VELCRO loop fastener(s) optionally configured to couple with hook fasteners such as a VELCRO hook fastener(s) positioned on a bottom-side surface of a commercially available mop head. The functional side of the VELCRO loop or hook material faces away from the barrier layer 140. The VELCRO loop and hook fasteners are configured to withstand the pressure and stress associated with typical mopping and scrubbing motions against a cleaning surface. The VELCRO loop and hook fasteners substantially limit the cleaning pad 100 from shifting, bunching, or otherwise becoming unattached, either partially or in whole, from the cleaning implement. The attachment member(s) 145 may optionally be designed in such a way as to allow for attachment to multiple types of commercially available mop systems.

While the exemplary embodiment illustrated in FIGS. 1, 1A and 1B utilizes a loop fastener for attachment to a hook fastener of another component, the cleaning pad is alternatively provided with a hook fastener for attachment to a loop fastener positioned on another component. Also, other forms of fasteners are contemplated as well, including adhesives, co-adhesives, and other known fastening mechanisms. Alternative attachment mechanisms are disclosed in U.S. application Ser. No. 11/241,438, filed concurrently herewith. The disclosure of U.S. application Ser. No. 11/241,438 is incorporated herein by reference in its entirety.

In this exemplary embodiment, the position adhesive 160 provides an attachment means to temporarily couple the cleaning pad 100 to a cleaning implement. The position adhesive 160 facilitates releasable engagement of the cleaning pad 100 to a surface of a cleaning implement. That surface may be the bottom side surface of a mop head or another portion of a cleaning implement. The position adhesive 160 is optionally a double sided adhesive configured to couple with two different surfaces. The bottom side of the position adhesive 160 is adhered to the film layer 165 and the top side is covered by the release sheet 161.

The adhesive bond between the position adhesive 160 and the film layer 165 is desirably greater than the adhesive bond between the position adhesive 160 and the cleaning implement so as to prevent the position adhesive 160 from remaining on the surface of the cleaning implement upon removal of the cleaning pad 100 from the cleaning implement. In other words, it is desirable that upon removal of the cleaning pad 100 from the cleaning implement, the entire position adhesive 160 is intact and mounted to the film layer 165 of the cleaning pad and no residue of the position adhesive 160 remains on the surface of the cleaning implement.

Furthermore, the adhesive bond between the position adhesive 160 and the cleaning implement is desirably strong enough so that the position adhesive 160 resists disengaging from the cleaning implement upon use of the cleaning pad. Conversely, the adhesive bond between the position adhesive 160 and the cleaning implement is desirably weak enough to disengage the cleaning pad 100 from the cleaning implement. A suitable position adhesive 160 is currently sold and distributed by the National Starch and Chemical Corporation of Bridgewater, N.J., USA.

Although the length of the position adhesive 160 selected for illustration is less than the length "B" of the cleaning pad 100, it should be understood that the length of the position adhesive 160 may be any dimension equal to or less than the length "B" of the cleaning pad 100. In another exemplary embodiment, not shown in the Figures, the length of the position adhesive 160 is desirably equal to the length "B" of the cleaning pad 100. From the manufacturing perspective, it is contemplated that a roll of barrier material having a continuous position adhesive strip 160 is advantageous for a high production volume application. In such case, the barrier roll with continuous position adhesive would be separated into individual barriers 140 with position adhesive 160 to be applied to each cleaning pad 100.

The release sheet 161 is applied to the top of the position adhesive 160 to protect and preserve the adhesive layer of the position adhesive 160 so that the position adhesive 160 retains its adhesion properties. Accordingly, the size of the release sheet 161 is equal to or, more desirably, larger than the position adhesive 160 to protect the entire position adhesive 160. The position adhesive 160 is illustrated in dotted line form to indicate that the adhesive 160 is positioned below the release sheet 161. In practice, the cleaning pad 100 is shipped with the release sheet 161 pre-applied to the position adhesive 160. The user removes the release sheet 161 from the position adhesive 160 prior to use of the cleaning pad 100. Although, if the cleaning implement is configured to mount with the attachment members 145, the position adhesive is not required. In such case, the user is not required to remove the release sheet 161 from the position adhesive 160.

As illustrated in FIG. 1, the width of the release sheet 161 is greater than the width of the position adhesive 160 to facilitate easy removal of the release sheet 161 from the position adhesive 160. In use, the user grasps the release sheet 161 in an area where the release sheet 161 is not adhered to the position adhesive 160 to avoid contact with the tacky position adhesive 160. Alternatively, if the width of the release sheet 161 is less than or equal to the width of the position adhesive 160, the user would conceivably lift the release sheet 161 from the tacky position adhesive 160 using a finger nail.

In the course of the assembly process, the position adhesive 160 is applied to the release sheet 161 before it is applied to the film layer 165. The temperature of the post-processed position adhesive 160 is to great to immediately apply it directly to the film layer 165, as the position adhesive 160 could melt or burn the film layer 165. Accordingly, the position adhesive 160 is applied to the release sheet 161 first, permitted to cool down to a pre-determined temperature and then transfer coated onto the film layer 165.

The tab portion 170 is provided to ease the removal of the absorbent cleaning pad 100 from the cleaning implement. In use, the user tugs on the tab portion 170 to remove the cleaning pad 100 from the cleaning implement without having to contact the dirty pad body 120, dirty lofty cuffs 125 or the cleaning implement. The tab portion 170 sits on a plane substantially parallel with the cleaning side 121 of the pad body 120 and extends outwardly from the pad body 120, lofty cuffs 125 and the cleaning implement. Accordingly, the tab portion 170 is desirably formed from a rigid or semi-rigid material so that it substantially retains its form and parallel orientation with the cleaning side of the pad body.

The tab portion 170 is desirably positioned in close proximity to a corner of the cleaning pad 100 to facilitate easy removal of the cleaning pad 100 from the cleaning implement. In other words, it is considerably easier for the user to peel the corner of the cleaning pad 100 away from the cleaning implement than to peel an entire side of the cleaning pad 100 away from the cleaning implement.

Although the tab portion 170 is adhered to the barrier layer 140 as illustrated in FIGS. 1 and 1A, the tab portion 170 may also be adhered to the pad body 120 or the film layer 165 with an adhesive 130. In another embodiment not illustrated herein, the tab portion 170 is integral with and extends from the attachment member, which will be described in further detail later. Although the embodiment selected for illustration includes only one tab portion 170, a plurality of tab portions 170 could be positioned on any longitudinal side or corner of the cleaning pad 100.

The adhesive 130 of the exemplary embodiment may be composed of any material sufficient to provide a bond between the components of the cleaning pad 100. In the exemplary embodiment and by way of non-limiting example, one exemplary adhesive is manufactured by H.B. Fuller Company of St. Paul, Minn., e.g., Part Number 1696. However, one skilled in the art will recognize that other types of adhesive and other fastener mechanisms are suitable for this application.

The details of the construction and assembly of the exemplary cleaning pad are disclosed in U.S. application Ser. No. 11/241,438, filed concurrently herewith. The disclosure of U.S. application Ser. No. 11/241,438 is incorporated herein by reference in its entirety.

Figure 2A:
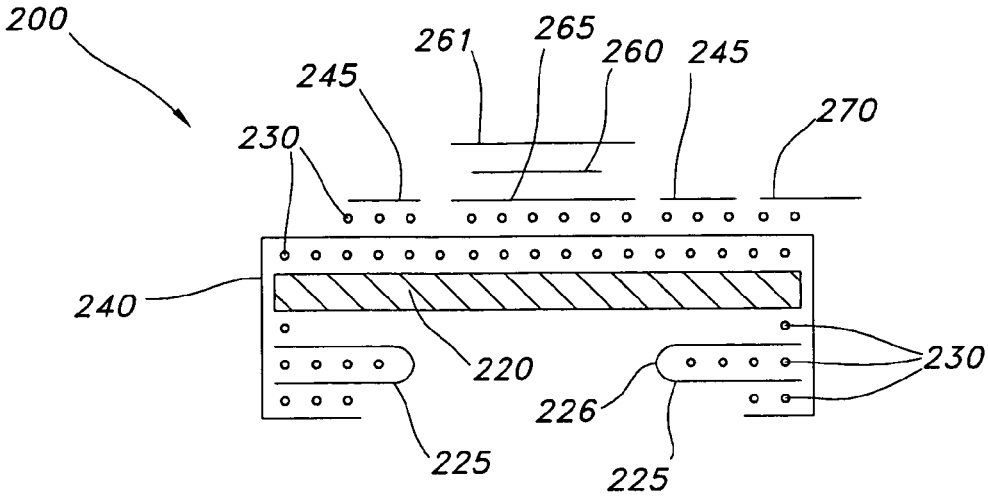
FIG. 2A is a cross-sectional view of the absorbent cleaning pad taken along the line 2A-2A illustrated in FIG. 2.
Figure 2:
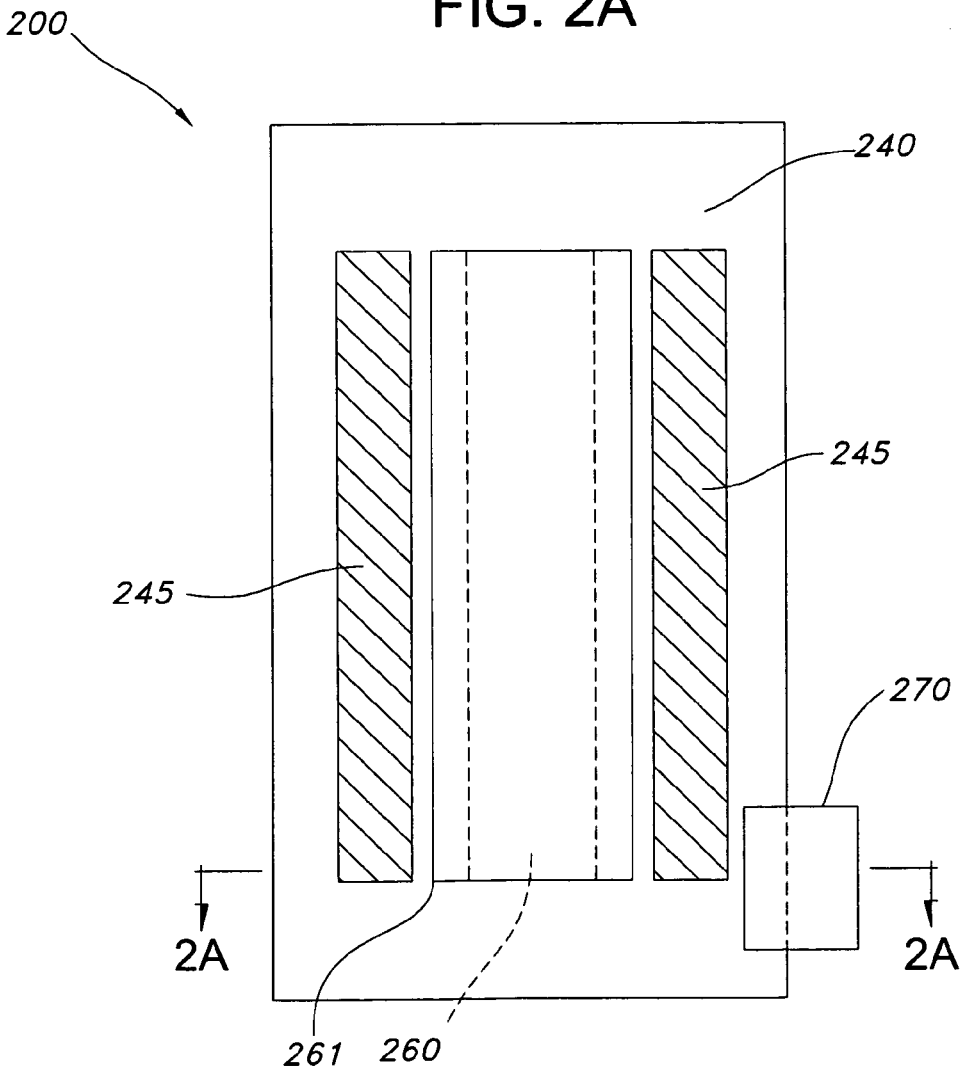
FIG. 2 is a top plan view of an absorbent cleaning pad in accordance with another exemplary embodiment of the present invention.

Similar to the absorbent cleaning pad embodiment illustrated in FIGS. 1, 1A and 1B, the exemplary embodiment of a cleaning pad 200 shown in FIGS. 2 and 2A is provided with a pad body 220, two lofty cuffs 225, barrier layer 240, two attachment members 245, position adhesive 260 with release sheet 261, tab portion 270, hydrophobic film layer 265 and a cut and place barrier (not shown). In this exemplary embodiment, the width of the film layer 265 is less than the width of the film layer 165 of the previous embodiment. The film layer 265 is smaller in this embodiment to reduce the material expense of the cleaning pad 200. The attachment members 245 of this embodiment are applied directly to the barrier layer 240.

Figure 3A:
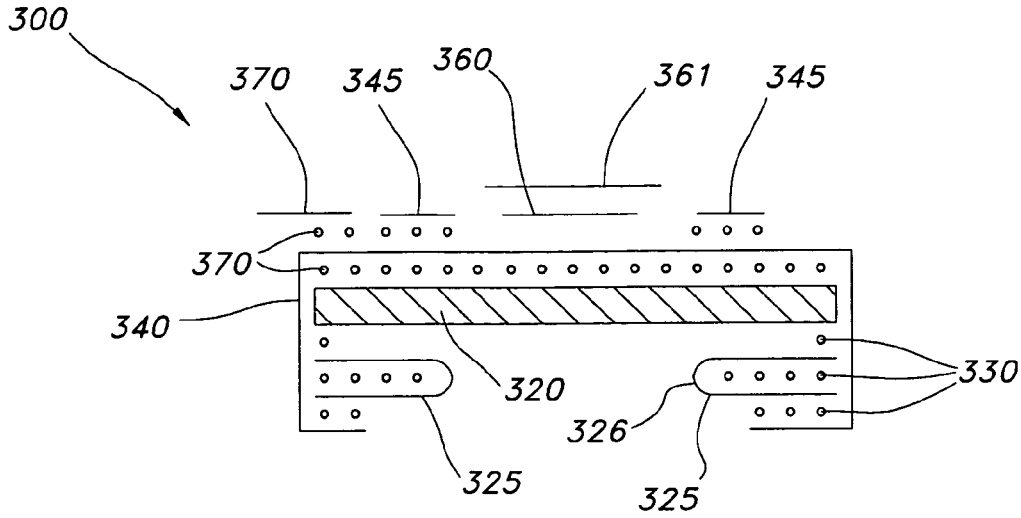
FIG. 3A is a cross-sectional view of the absorbent cleaning pad taken along the line 3A-3A illustrated in FIG. 3.
Figure 3:
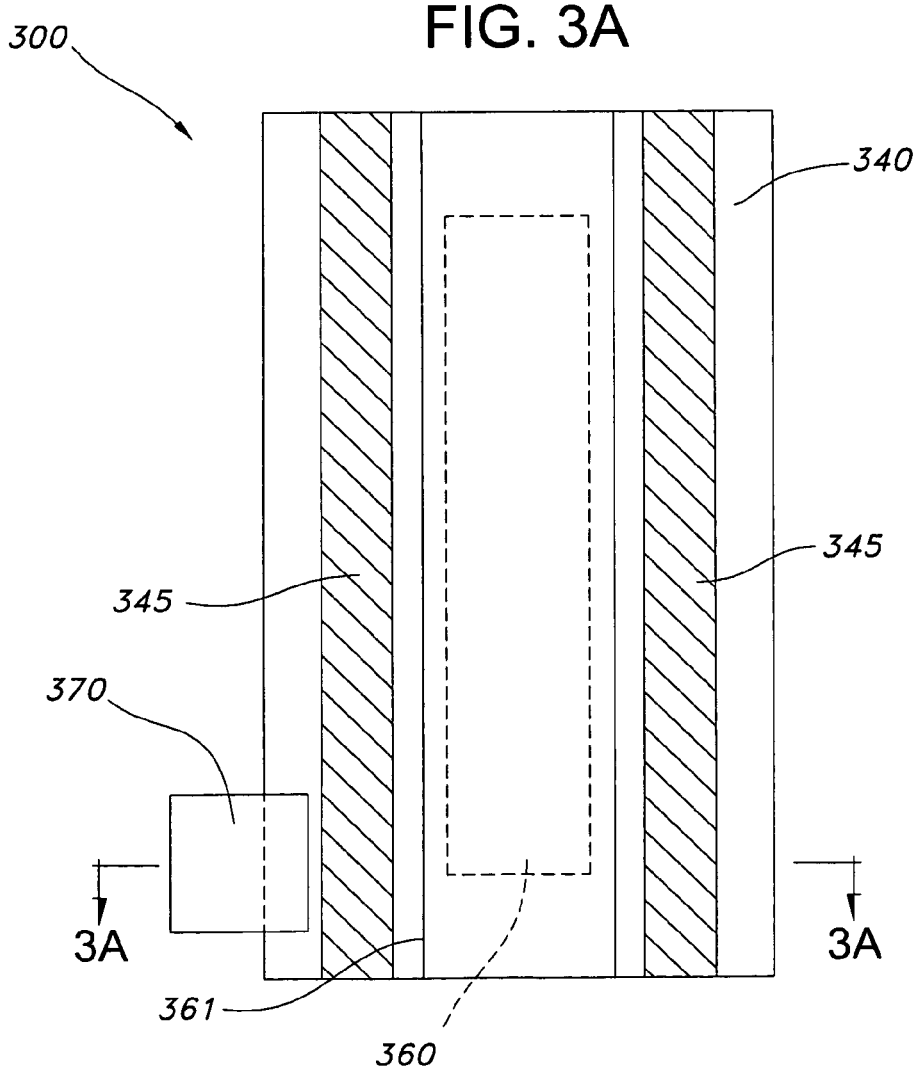
FIG. 3 is a top plan view of an absorbent cleaning pad in accordance with yet another exemplary embodiment of the present invention.

Similar to the absorbent cleaning pad embodiment illustrated in FIGS. 2 and 2A, the exemplary embodiment of a cleaning pad 300 shown in FIGS. 3 and 3A is provided with a pad body 320, two lofty cuffs 325, two attachment members 345, tab portion 370, barrier layer 340, position adhesive 360 with release sheet 361 and a cut and place barrier (not shown). In this exemplary embodiment, the barrier layer 340 is composed of a hydrophobic material, similar to the material of the film layers 165 and 265 of the previous embodiments, thereby eliminating the need for a secondary film layer (e.g. 165 and 265). The hydrophobic material of the barrier layer 340 limits fluid from passing to the cleaning implement to keep the cleaning implement free of dirty fluid. The hydrophobic material of the barrier layer 340 also provides a better surface than a non-woven material for the adhesion of the attachment members 345, tab portion 370 and the position adhesive 360. An adhesive 330 is provided to adhere the attachment members 345 and the tab portion 370 to the barrier layer 340. By virtue of the non-porous structure of the barrier layer, less adhesive 330 is required to adequately adhere the attachment members 345 and the tab portion 370 to the barrier layer 340.

The length of the release sheet 361 of this embodiment is significantly greater than the length of the position adhesive 360 to facilitate easy removal of the release sheet 361 from the position adhesive 360, the benefits of which have already been described. In addition to the release sheet 361 modification, the attachment members 345 of this embodiment extend along the entire length of the pad body 320 for greater adhesion to the cleaning implement.

Figure 6A:
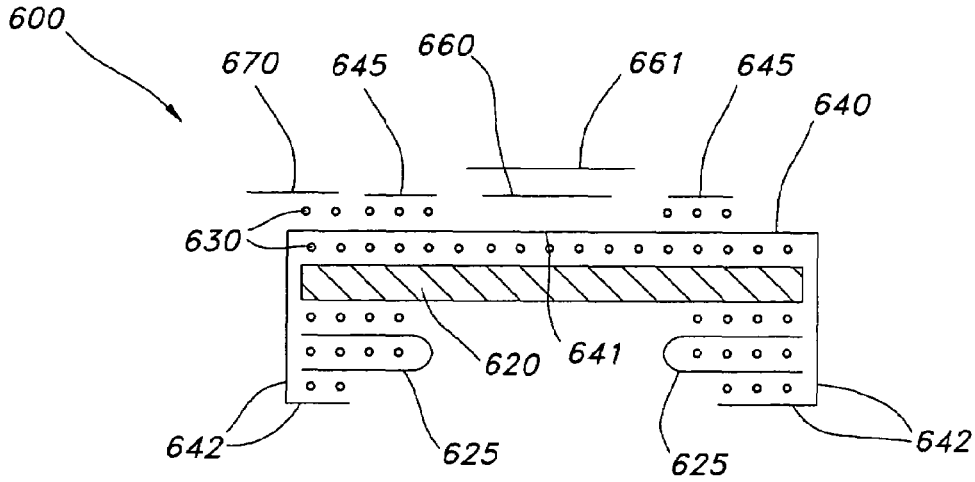
FIG. 6A is a cross-sectional view of the absorbent cleaning pad taken along the line 6A-6A illustrated in FIG. 6.
Figure 6:
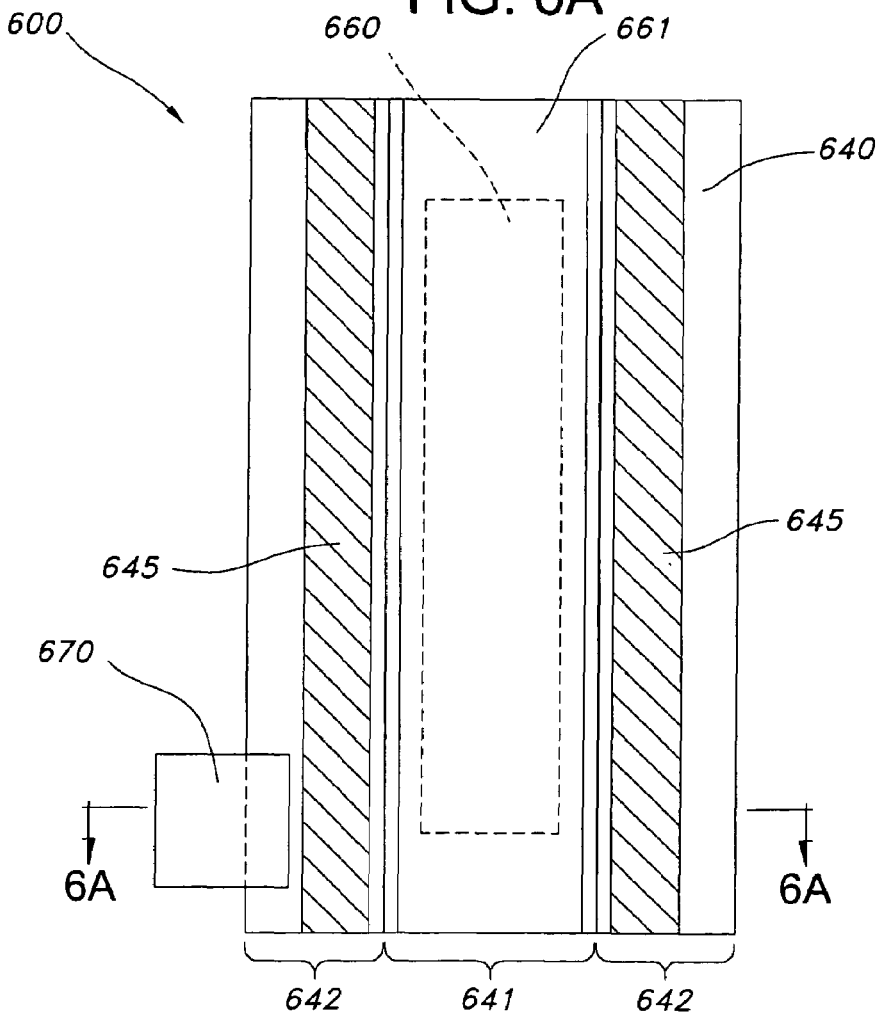
FIG. 6 is a top plan view of an absorbent cleaning pad in accordance with yet another exemplary embodiment of the present invention.

Similar to the absorbent cleaning pad embodiment illustrated in FIGS. 3 and 3A, the exemplary embodiment of a cleaning pad 600 shown in FIGS. 6 and 6A is provided with a pad body 620, two lofty cuffs 625, barrier layer 640, two attachment members 645, tab portion 670, position adhesive 660 with release sheet 661 and a cut and place barrier (not shown). In this embodiment the barrier layer 640 is composed of a unique material that is partially hydrophobic and partially hydrophilic. The hydrophobic portion 641 is positioned in the central region of the cleaning pad 600 and configured to limit fluid from passing from the pad body 620 to the position adhesive and/or the cleaning implement. The width of the hydrophobic portion 641 may be any size equal to or smaller than the width of the cleaning implement. The hydrophilic portions 642 positioned on both of the folded sides of the cleaning pad 600 are configured to deliver the fluid from the cleaning surface and into the pad body 620 for absorption and removal from the cleaning surface. As described previously, if the barrier layer 640 were formed from a substantially impervious and hydrophobic material, the length-wise sides of the barrier layer 640 would merely push the fluid over the surface being cleaned, as opposed to delivering the fluid to the pad body 620 for absorption. The unique barrier layer 640 alleviates the necessity for a separate film layer, which could represent a cost savings.

Figure 4A:
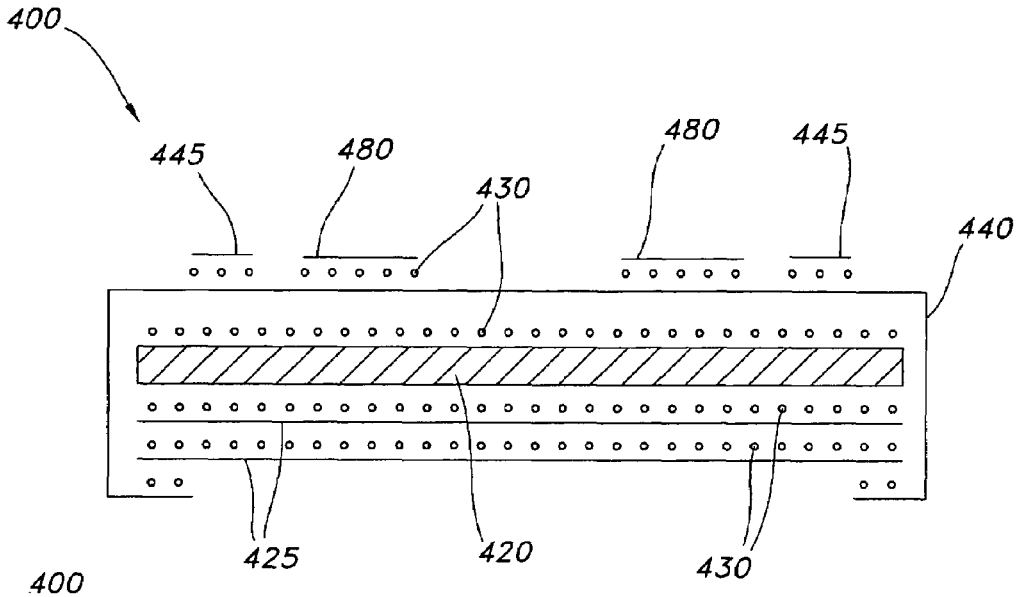
FIG. 4A is a cross-sectional view of the absorbent cleaning pad taken along the line 4A-4A illustrated in FIG. 4.
Figure 4:
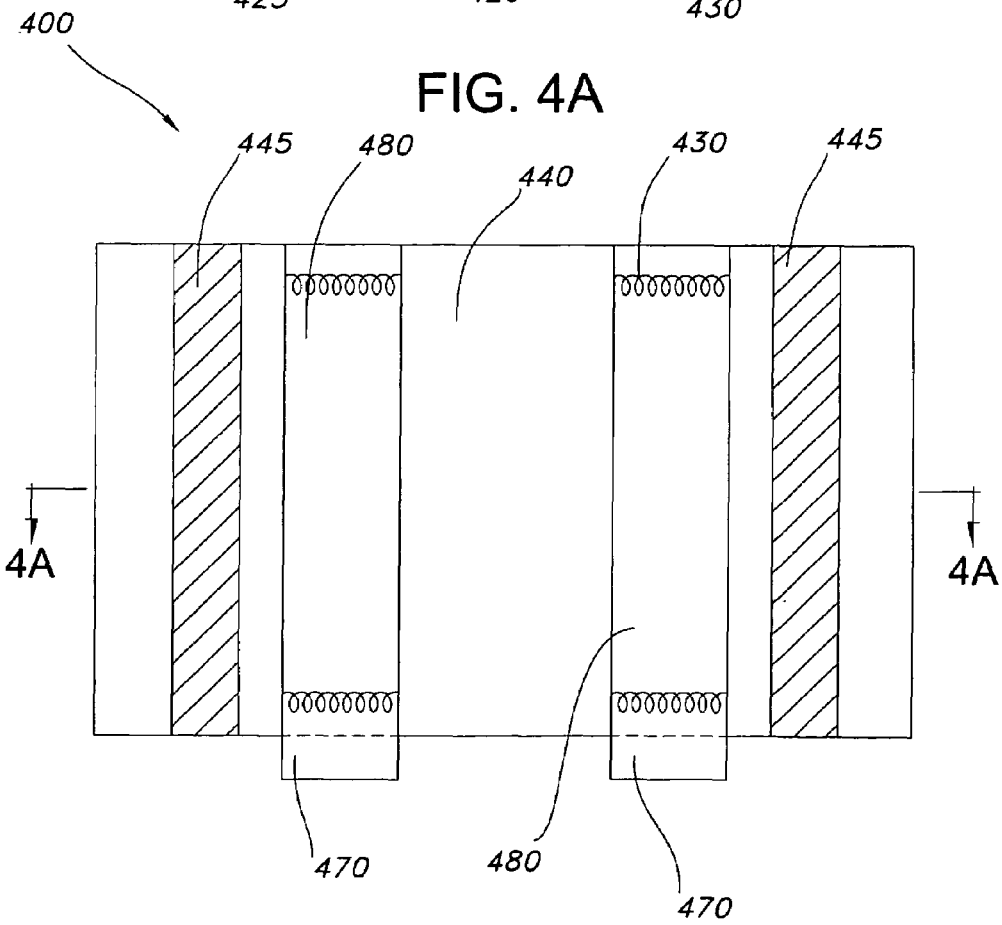
FIG. 4 is a top plan view of an absorbent cleaning pad in accordance with still another exemplary embodiment of the present invention.

Similar to the absorbent cleaning pad embodiment illustrated in FIGS. 1, 1A and 1B, the exemplary embodiment of a cleaning pad 400 shown in FIGS. 4 and 4A is provided with a pad body 420, two lofty cuffs 425 (one folded cuff shown), barrier layer 440, two attachment members 445, tab portions 470 and a cut and place barrier (not shown). In this embodiment, the cleaning pad 400 is provided with straps 480 configured to wrap around a cleaning implement. The two straps 480 are oriented along the width of the cleaning pad 400 and positioned to accept the head of the cleaning implement. The straps 480 and the barrier layer 440 define a passage sized and positioned to receive a head portion of a commercially available cleaning implement. In use, the head portion of the cleaning implement is positioned beneath one of the straps 480 and the other strap 480 is lifted or optionally stretched around the head portion of the cleaning implement to fully engage and substantially retain the head portion of the cleaning implement.

The straps 480 may have elastic functionality configured to stretch around the head portion of the cleaning implement and retain the cleaning implement. By way of non-limiting example, the elastic strap is formed from a material having an elastic elongation limit of at least approximately 100 percent and more preferably at least approximately 250 percent. The straps 480 may optionally be composed of hook or loop fastener material. Although not shown, in another embodiment, the cleaning pad includes straps formed from loop or hook material thereby eliminating the need for the attachment members 445. In such an embodiment, the straps would be configured to wrap around the head of a cleaning implement in one configuration and mount to a surface of the cleaning implement in another configuration.

The straps 480 are also configured to permit the user to operate the cleaning pad 400 independent from a cleaning implement. The cleaning pad 400 may be useful for hand-cleaning any small, delicate, or non-planar surface that the cleaning implement can not clean or is unable to access. The strap 480 may be composed of any elastic material flexible enough to accommodate a child and an adult-sized hand and rigid enough to firmly grip a child and an adult-sized hand.

The tab portions 470 are integral with and extend from the straps 480, as illustrated in FIG. 4. Similar to the tab portions 170, 270, 370, 470, 670 of the previous embodiments, the tab portions 470 are provided to ease the removal of the cleaning pad 400 from the cleaning implement.

Figure 5A:
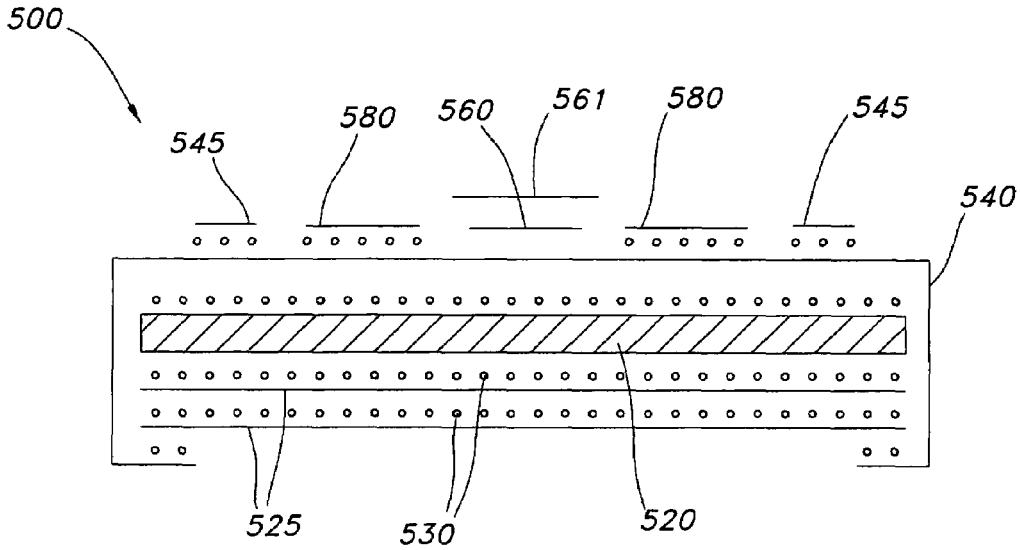
FIG. 5A is a cross-sectional view of the absorbent cleaning pad taken along the line 5A-5A illustrated in FIG. 5.
Figure 5:
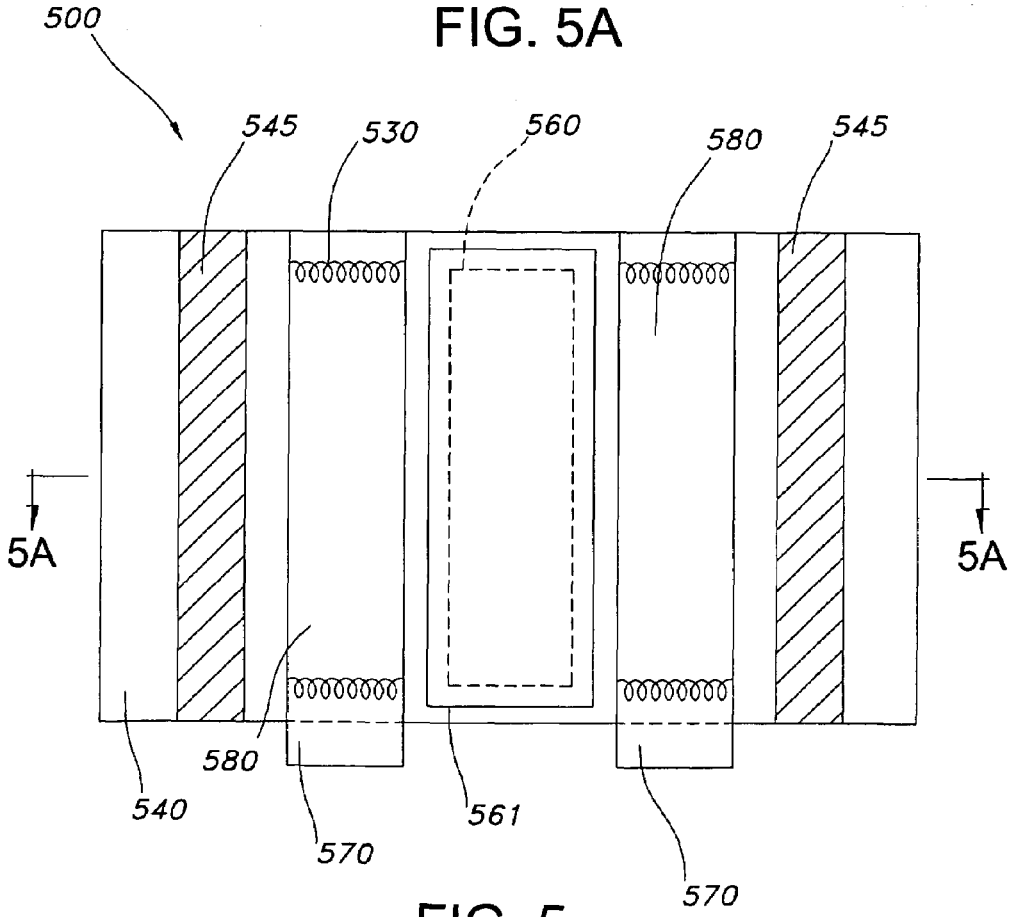
FIG. 5 is a top plan view of an absorbent cleaning pad in accordance with another exemplary embodiment of the present invention.

Similar to the absorbent cleaning pad embodiment illustrated in FIGS. 4 and 4A, the exemplary embodiment of a cleaning pad 500 shown in FIGS. 5 and 5A is provided with a pad body 520, two lofty cuffs 525 (one folded cuff shown), barrier layer 540, two attachment members 545, tab portions 570, two straps 580 and a cut and place barrier (not shown). In this embodiment, the cleaning pad 500 includes a position adhesive 560 with a release sheet 561. As described previously, the position adhesive 560 provides an attachment mechanism to temporarily couple the cleaning pad 500 to a cleaning implement. The position adhesive 560 facilitates releasable engagement of the cleaning pad 500 to a surface of a cleaning implement. The release sheet 561 is applied above the position adhesive 560 to shield and preserve the position adhesive 560 prior to its use.

Although the invention is illustrated and described herein with reference to specific embodiments, the invention is not intended to be limited to the details shown. Rather, various modifications may be made in the details within the scope and range of equivalents of the claims and without departing from the invention. Also, the embodiments selected for illustration in the figures are not shown to scale and are not limited to the proportions shown.

What is claimed:

1. A surface cleaning pad comprising a pad body and an attachment surface associated with said pad body and positioned to face a cleaning implement, said attachment surface comprising a substantially hydrophilic portion and a substantially hydrophobic portion, said attachment surface defined at least in part by a barrier layer including said substantially hydrophilic portion and said substantially hydrophobic portion, said barrier layer being folded over at least one edge of said pad body, thereby encapsulating said edge of said pad body.

2. The surface cleaning pad of claim 1 further comprising an attachment member directly coupled to said substantially hydrophobic portion of said barrier layer.

3. The surface cleaning pad of claim 2, said attachment member being positioned for engagement with a cleaning implement.

4. The surface cleaning pad of claim 3, said attachment member comprising a position adhesive.

5. The surface cleaning pad of claim 1 wherein a folded portion of said barrier layer is substantially hydrophilic.

6. The surface cleaning pad of claim 1 wherein a folded portion of said barrier layer is applied to a surface of said pad body that is opposed to said attachment surface and positioned to face a surface to be cleaned.

7. The surface cleaning pad of claim 6, wherein said folded portion of said barrier layer is substantially hydrophilic.

8. The surface cleaning pad of claim 1 wherein said attachment surface comprises a substantially hydrophobic layer defining said hydrophobic portion and a substantially hydrophilic layer defining said hydrophilic portion and associated with said substantially hydrophobic layer.

9. The surface cleaning pad of claim 8, said substantially hydrophilic layer being directly applied to said pad body.

10. The surface cleaning pad of claim 9 wherein said substantially hydrophobic layer is positioned over said hydrophilic layer.

11. The surface cleaning pad of claim 10 further comprising an attachment member directly coupled to said hydrophobic layer and positioned to face the cleaning implement.

12. The surface cleaning pad of claim 11, said attachment member comprising a position adhesive.

13. The surface cleaning pad of claim 1, said pad body being formed from a unitized airlaid composite.

14. A surface cleaning pad for use with a cleaning implement, said surface cleaning pad consisting of:

a unitized pad body formed from an airlaid composite;

a barrier layer coupled adjacent a cleaning-implement-facing surface of said unitized pad body, said barrier layer being folded over at least one edge of said pad body, thereby encapsulating said edge of said pad body;

a hydrophobic layer coupled adjacent said barrier layer;

a position adhesive applied to said hydrophobic layer and positioned for engaging the cleaning implement; and a release sheet applied over a functional surface of said position adhesive.

15. The surface cleaning pad of claim 14 wherein a folded portion of said barrier layer is substantially hydrophilic.

16. The surface cleaning pad of claim 14 wherein a folded portion of said barrier layer is applied to a surface of said pad body that is opposed to said cleaning-implement-facing surface and positioned to face a surface to be cleaned.

17. The surface cleaning pad of claim 16 wherein said folded portion of said barrier layer is substantially hydrophilic.

18. A method of assembling a surface cleaning pad consisting of the steps of:

a) applying a barrier layer to a cleaning implement facing surface of pad body formed from an airlaid composite;

b) folding the barrier layer over at least one edge of the airlaid composite, thereby encapsulating said edge of the airlaid composite;

c) applying the barrier layer to an opposing surface of the pad body that is positioned to face a surface to be cleaned;

d) positioning a hydrophobic layer over the barrier layer;

e) coupling a position adhesive to the hydrophobic layer, wherein a functional surface of the position adhesive is configured to engage a cleaning implement; and f) mounting a release sheet to the functional surface of the position adhesive.

19. A surface cleaning pad configured for use with a cleaning implement, said surface cleaning pad comprising:

a unitized pad body formed from an airlaid composite, said unitized pad body having a cleaning-implement-facing surface configured to face the cleaning implement and a surface-cleaning surface, wherein at least a portion of said surface-cleaning surface is exposed for direct contact with a surface to be cleaned; and a barrier layer coupled adjacent said cleaning-implement-facing surface of said unitized pad body and positioned to face the cleaning implement, wherein said barrier layer comprises a hydrophobic portion, said barrier layer being folded over at least one edge of said unitized pad body, thereby encapsulating said edge of said unitized pad body.

20. The surface cleaning pad of claim 19 further comprising a position adhesive mounted to said hydrophobic portion of said barrier layer, said position adhesive including a release sheet.

21. The surface cleaning pad of claim 19 wherein said folded portion of said barrier layer is substantially hydrophilic.

* * * * *